US008594347B2

(12) United States Patent
Ryan et al.

(10) Patent No.: US 8,594,347 B2
(45) Date of Patent: Nov. 26, 2013

(54) MICROPHONE HAVING MULTIPLE TRANSDUCER ELEMENTS

(75) Inventors: William A. Ryan, Elgin, IL (US); Michael Abry, Kildeer, IL (US); Peter V. Loeppert, Hoffman Estates, IL (US)

(73) Assignee: Knowles Electronics LLC, Itasca, IL (US)

( * ) Notice: Subject to any disclaimer, the term of this patent is extended or adjusted under 35 U.S.C. 154(b) by 0 days.

(21) Appl. No.: 13/456,348

(22) Filed: Apr. 26, 2012

(65) Prior Publication Data

US 2012/0207334 A1 Aug. 16, 2012

Related U.S. Application Data

(63) Continuation of application No. 12/577,491, filed on Oct. 12, 2009, now Pat. No. 8,170,244.

(60) Provisional application No. 61/105,073, filed on Oct. 14, 2008.

(51) Int. Cl.
*H04R 25/00* (2006.01)
*H04R 1/40* (2006.01)

(52) U.S. Cl.
CPC ..... *H04R 1/406* (2013.01)
USPC ..... 381/174; 381/175; 381/355

(58) Field of Classification Search
USPC ..... 381/355, 361, 369, 174, 175
See application file for complete search history.

(56) References Cited

U.S. PATENT DOCUMENTS

| | | | |
|---|---|---|---|
| 2007/0202627 | A1 | 8/2007 | Minervini |
| 2007/0278601 | A1 | 12/2007 | Goodelle et al. |
| 2008/0037768 | A1 | 2/2008 | Hsu et al. |

FOREIGN PATENT DOCUMENTS

| | | | |
|---|---|---|---|
| KR | 10-0648398 | B1 | 11/2006 |
| KR | 10-0737726 | B1 | 7/2007 |
| KR | 10-737728 | B1 | 7/2007 |
| WO | 2007-017819 | A1 | 2/2007 |

OTHER PUBLICATIONS

International Search Report and Written Opinion for PCT/US2009/060115, dated Jun. 4, 2010.

*Primary Examiner* — Tuan D Nguyen
(74) *Attorney, Agent, or Firm* — Dykema Gossett PLLC

(57) ABSTRACT

A microphone is provided. The microphone has a housing; an acoustic port located in the housing; a substrate coupled with the housing; an integrated circuit positioned onto the substrate; and two or more MEMS transducers mounted on the substrate wherein the transducers are connected in parallel.

2 Claims, 8 Drawing Sheets

MICROPHONE HAVING MULTIPLE TRANSDUCER ELEMENTS

CROSS REFERENCES TO RELATED APPLICATIONS

This application is a continuation of U.S. application Ser. No. 12/577,491, filed on Oct. 12, 2009 entitled "Microphone Having Multiple Transducer Elements," now U.S. Pat. No. 8,170,244, which claims the benefit of U.S. Provisional Application No. 61/105,073, filed on Oct. 14, 2008 entitled "Microphone Having Multiple Transducer Elements," the contents of which are incorporated herein by reference in their entireties.

TECHNICAL FIELD

This patent relates to a microphone having two or more transducer elements.

BRIEF DESCRIPTION OF THE DRAWINGS

For a more complete understanding of the disclosure, reference should be made to the following detailed description and accompanying drawings wherein.

Figure 1:
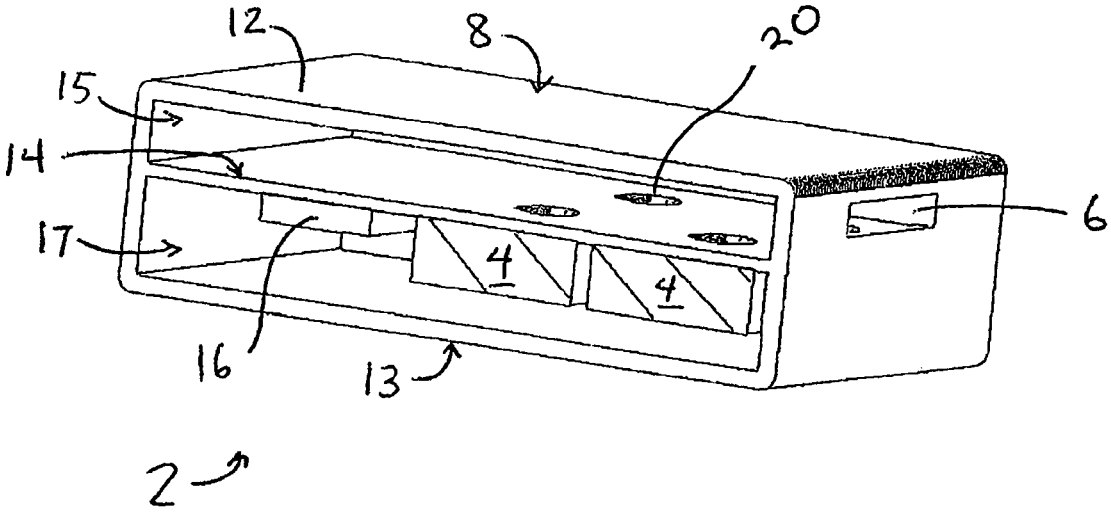
FIG. 1 illustrates a cutaway perspective view of a microphone utilizing multiple transducers according to the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

In an embodiment, a microphone is provided. The microphone has a housing; an acoustic port located in the housing; a substrate coupled with the housing; an integrated circuit positioned onto the substrate; and two or more MEMS transducers mounted on the substrate wherein the transducers are connected in parallel.

In an embodiment, the substrate is comprised of silicon.

In an embodiment, the substrate is comprised of a ceramic material.

In an embodiment, the substrate provides acoustic isolation between a front cavity and a rear cavity.

In an embodiment, at least one of the MEMS transducers has an opening to allow sound to impinge upon the transducer.

In an embodiment, the transducers are well matched.

In an embodiment, two or more MEMS transducers form a monolithic MEMS transducer element.

In an embodiment, the integrated circuit is a buffer circuit.

In an embodiment, at least one of the MEMS transducer elements is a variable capacitor.

In another embodiment, a microphone is provided. The microphone has a housing; an acoustic port located in the housing; a substrate coupled to the housing; an integrated circuit positioned onto the substrate; and a plurality of MEMS transducers mounted on the substrate wherein two or more of the plurality of transducers are connected in parallel.

In an embodiment, the substrate is comprised of silicon.

In an embodiment, the substrate is comprised of a ceramic material.

In an embodiment, the substrate provides acoustic isolation between a front cavity and a rear cavity.

In an embodiment, at least one of the MEMS transducers has an opening to allow sound to impinge upon the transducer.

In an embodiment, at least two of the transducers are well matched.

In an embodiment, two or more of the plurality of MEMS transducers form a monolithic MEMS transducer element.

In an embodiment, the integrated circuit is a buffer circuit.

In an embodiment, at least one of the plurality of MEMS transducer elements is a variable capacitor.

FIG. 1 illustrates a microphone 2 having multiple acoustic transducer elements 4. The microphone may be constructed from materials such as, for example, stainless steel or other stamped metal, or the like. Sound may enter into the microphone 2 through an acoustic port 6 located within a top cup 8. The top cup 8 may be defined as an area extending horizontally from one side of the microphone to the other, and vertically from a baffle plate 14 to a top surface 12 of the microphone 2. The baffle plate 14 resides between the top cup and bottom cup and may provide acoustic isolation between a front cavity 15 and a rear cavity 17. The baffle plate 14 may be constructed from materials such as metal, ceramic, or the like. Positioned upon the baffle plate 14 are acoustic transducer elements 4 which may be in connection with the baffle plate 14 via, for example, surface mounting, adhesive bonding, or any other method contemplated by one of ordinary skill in the art. The transducer elements 4 may be, for example, MEMS Microphone transducers. A buffer integrated circuit 16 is adjacent to one or more of the transducer elements 4. The buffer integrated circuit may be in connection with the baffle plate 14 via, for example, surface mounting, adhesive bonding, or any other method contemplated by one of ordinary skill in the art. Each of the acoustic transducer elements 4 contains a sound port to allow sound to impinge upon the transducer element 4, resulting in an electrical output, which is buffered by the buffer integrated circuit 16. The sound may travel through one or more apertures 20 aligned with the sound port of the transducer elements 4.

In an embodiment, MEMS transducer elements can be used. By utilizing MEMS transducer elements, certain benefits can be realized. For example, the smaller size of MEMS acoustic transducers may allow the use of multiple transducer elements to maintain a small overall package. Since MEMS transducers use semiconductor processes, elements within a wafer can be well matched with regards to sensitivity. Sensitivity in MEMS transducers is determined by diaphragm mass, compliance, and motor gap. These parameters may be controlled since they are related to deposition thickness of the thin films that semiconductor fabrication processes use to deposit the materials used in MEMS and semiconductor devices. Use of well-matched transducers leads to optimal performance for sensitivity and noise, which optimizes signal-to-noise ratio (SNR).

In another embodiment, the MEMS acoustic elements do not need to be well matched. SNR benefits may be achievable when compared to a single-transducer configuration. By summing multiple transducer elements, the dependence of maintaining closely matched individual transducer elements may be minimized.

Referring again to FIG. 1, the top cup 8 structure may allow the acoustic port to be placed along any surface, i.e., the acoustic port can be placed on any of the long or short sides or in the top surface. This provides a flexible porting scheme to allow, for example, use in diverse applications.

Figure 2:
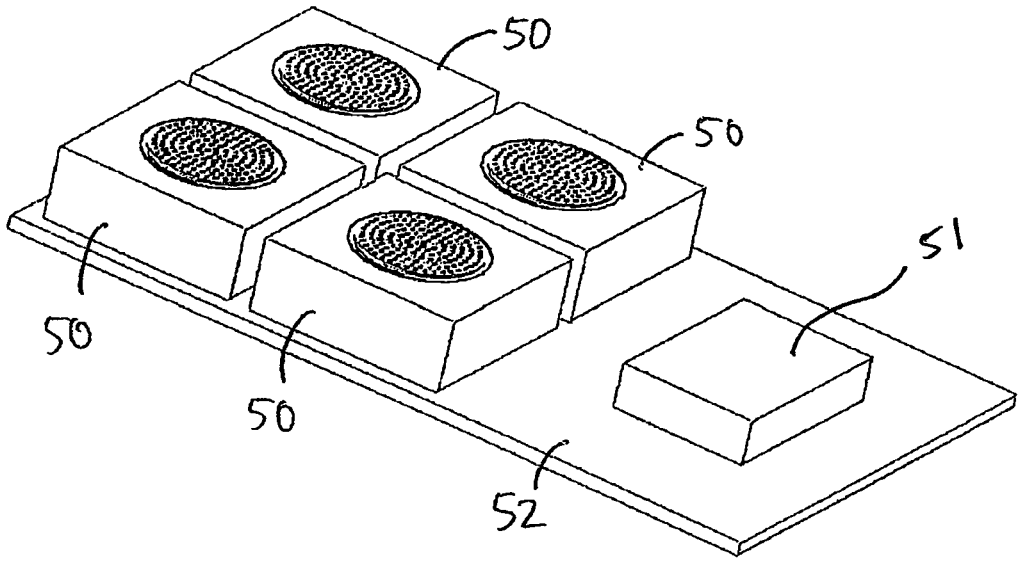
FIG. 2 illustrates a perspective view of four transducer elements mounted to a single baffle with a buffer element in an embodiment of the present invention.
Figure 3:
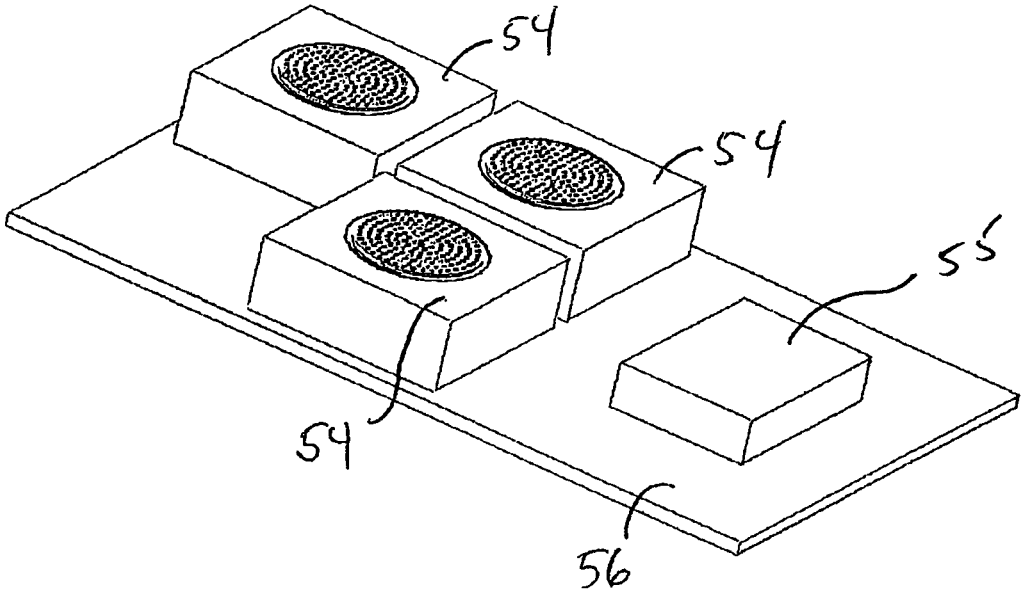
FIG. 3 illustrates a perspective view of three transducer elements mounted to a single baffle with a buffer element in an embodiment of the present invention.
Figure 4:
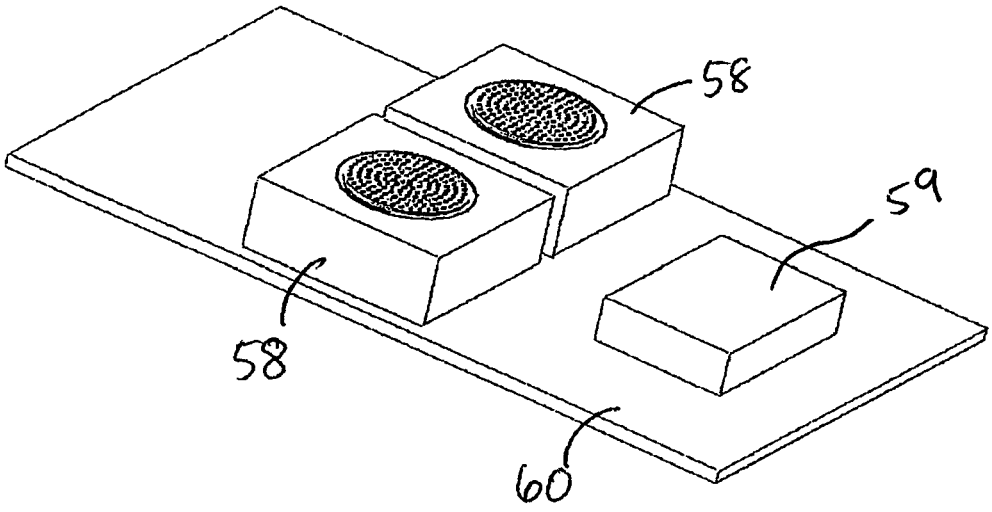
FIG. 4 illustrates a perspective view of two transducer elements mounted to a single baffle with a buffer element in an embodiment of the present invention.

Multiple matched transducer elements summed in a single microphone package may be able to achieve improved SNR. The degree of improvement is directly related to the number of transducers used. FIG. 2 illustrates an embodiment in which four transducers 50 are connected to a baffle 52. FIG. 3 illustrates an embodiment in which three transducers 54 are connected to a baffle 56. FIG. 4 illustrates an embodiment in which two transducers 58 are connected to a baffle 60. The degree of SNR improvement increases with the number of acoustic transducer elements. Higher SNR can be achieved with even greater number of transducers than those shown in FIGS. 2-4.

Figure 5:
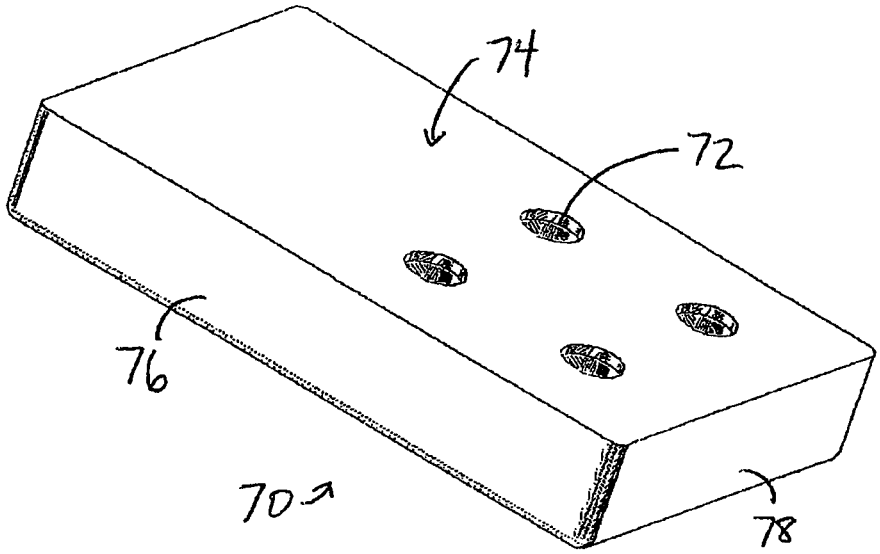
FIG. 5 illustrates a perspective view of a microphone in an embodiment of the present invention.

FIG. 5 illustrates another embodiment of the present invention. A microphone 70 has ports 72 in a top surface 74 which align with transducer elements (not shown, i.e., hidden by walls 76, 78). In this embodiment, the top cup structure is absent. As a result, a smaller microphone package can be achieved, which may allow for use in smaller-sized applications.

Figure 6:
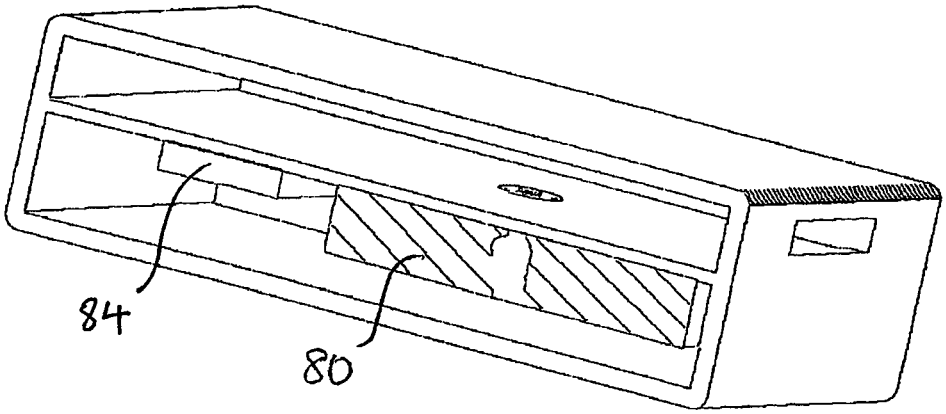
FIG. 6 illustrates a cutaway perspective view of a microphone utilizing a monolithic microphone unit comprised of two or more individual transducers in an embodiment of the present invention.
Figure 7:
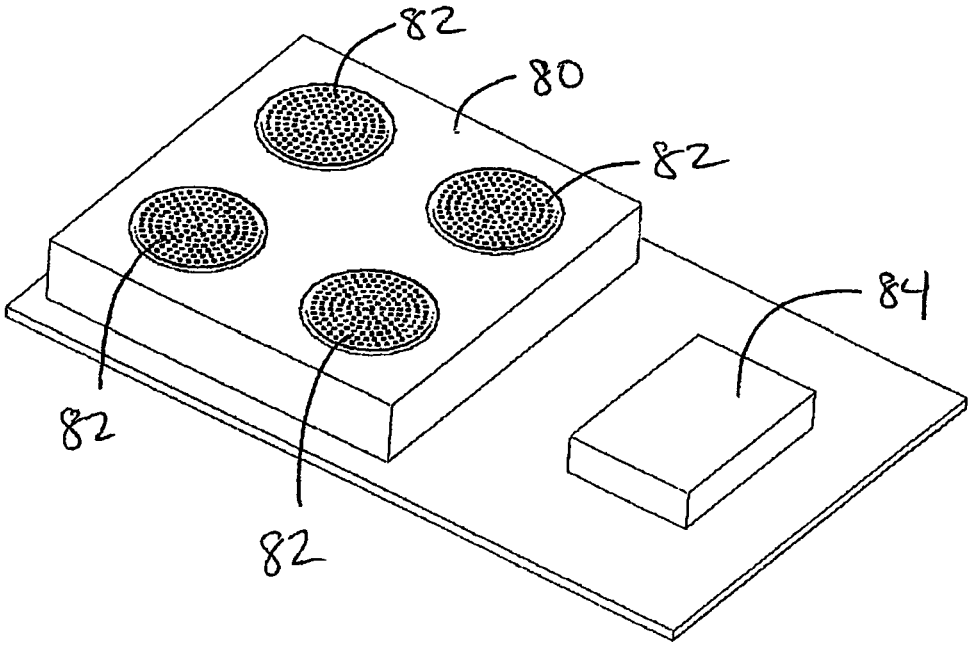
FIG. 7 illustrates a perspective view of a baffle with a monolithic transducer element comprised of four individual transducer elements in an embodiment of the present invention.

In yet another embodiment, illustrated in FIGS. 6 and 7, a monolithic MEMS transducer element 80 can be created that has two or more individual transducer elements 82. This can be achieved in a MEMS acoustic transducer by integrating multiple individual transducers onto a single substrate. This can entail singulation techniques to produce multiple motor assemblies onto a single monolithic device by dicing a desired number of transducers. Furthermore, a configuration can be designed utilizing multiple individual transducers where the individual transducer electrical connections are combined to minimize connection points. The transducer element 80 may be in connection with a buffer circuit 84. This embodiment may provide more efficient manufacturing and/or packaging since the need for handling multiple transducer elements may be eliminated.

Figure 8:
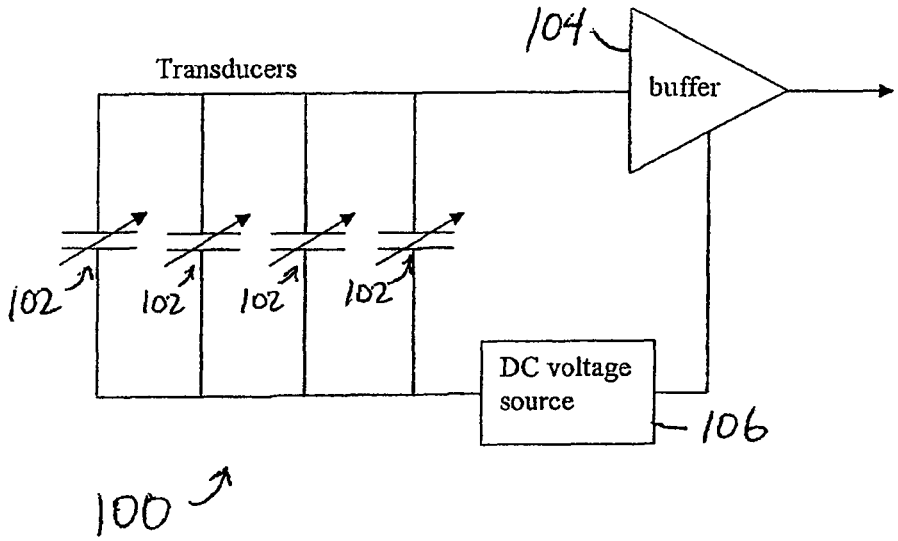
FIG. 8 is a schematic of a circuit showing connectivity of individual transducers to a buffer circuit in an embodiment of the present invention.

Looking to a schematic 100 shown in FIG. 8, the multiple transducer elements 102 are connected in parallel. In the schematic 100, the transducer elements 102 are represented as variable capacitors. The multiple elements 102 are connected in parallel and connected to the buffer circuit 104. The buffer integrated circuit 104 may be utilized to provide an impedance match between the high impedance transducer elements 102 and user interface circuitry. This allows the microphone to achieve maximum sensitivity without incurring signal loss in the final circuit. Signal to Noise Ratio (SNR) is maximized when transducers are well matched. Well matched transducers combined in this way will result in a microphone that has a sensitivity equal to the sensitivity of one the individual transducer elements but with an improved noise performance. A DC voltage source 106 is required for non-electret condenser transducer elements, but may not be required for electret style transducers.

Figure 10:
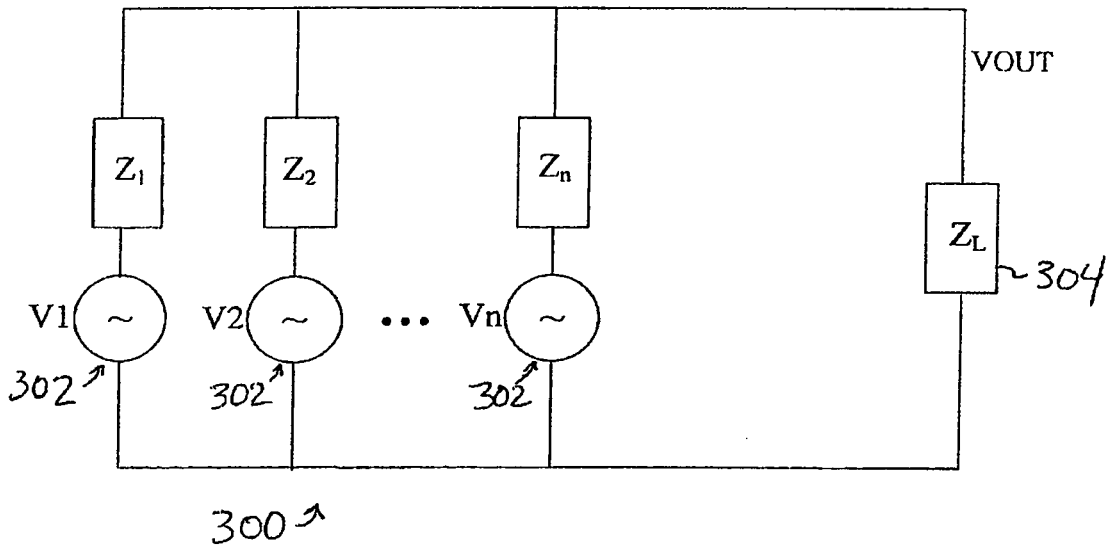
FIG. 10 is a schematic showing a superposition method of achieving higher Signal to Noise ratio with a plurality of transducer elements.

An analogous circuit diagram is shown in FIG. 10. In the circuit 300, n AC sources 302 are connected in parallel to drive a single load 304. Each of the n sources has a source impedance Zn and the total output is delivered to the load ZL 306. The output voltage, VOUT, can be calculated by superposition theory as below:

$$VOUT=V1*(Z2//Z3// \ldots //Zn//ZL)/(Z1+(Z2//Z3// \ldots //Zn//ZL))+V2*(Z1//Z3// \ldots //Zn//ZL)/(Z2+(Z1//Z3// \ldots //Zn//ZL))+ \ldots +Vn*(Z1//Z2// \ldots //Zn-1//ZL)/(Zn+(Z1//Z2// \ldots //Zn-1//ZL))$$

When the source impedance of each source is well matched, Z1=Z2= . . . Zn and the load impedance ZL is large with respect to the source impedance, the equation above can be reduced to the following:

$$VOUT=(1/n)*V1+(1/n)*V2+ \ldots +(1/n)*Vn$$

Furthermore, if V=V1=V2= . . . =Vn, such as is the case with closely matched sources, the output voltage can be represented by:

$$VOUT=n*(1/n)*V=V$$

The output voltage VOUT is equal to the source voltage of any of the matched sources.

The noise voltage of each of the voltage sources can be represented by N1, N2, . . . Nn. If the noise is uncorrelated, as is the case with thermal electronic or acoustic-resistive noise, the total system noise is represented by the sum of the individual noise power from each of the contributing sources.

The noise transfer function is the same as shown above, but when the noise power is added, the resultant noise is represented by:

$$(NOUT)2=(N1/n)2+(N2/n)2+ \ldots +(Nn/n)2$$

If the voltage sources are well matched in noise voltage, N=N1=N2= . . . =Nn $$NOUT=N*SQRT(1/n)$$

Signal to Noise Ratio (SNR) is calculated by a ratio of the system output resulting from a specified output to the noise floor of the system. For a system of multiple transducers where transducers are well matched, the SNR can be specified by:

$$SNR=VOUT/NOUT=V/(N*SQRT(1/n))$$

The SNR of a single transducer is represented by the ratio V/N. In a multiple transducer system, the SNR is effectively increased by:

$$SNR=(V/N)*SQRT(n)$$

As shown above, when matched transducers are used, an increase in SNR is achievable of the square root of the number of additional elements used in the system. As an example, 4 elements increase the SNR vs. single transducer performance by SQRT(4)=2 or 6 dB. This represents a theoretical maximum of SNR benefit by utilizing multiple transducer elements. Using the same formulae above, It follows that use of individual transducers that are not well matched may still provide a benefit in SNR, but with a maximum benefit specified by (V/N)*SQRT(n).

Figure 9:
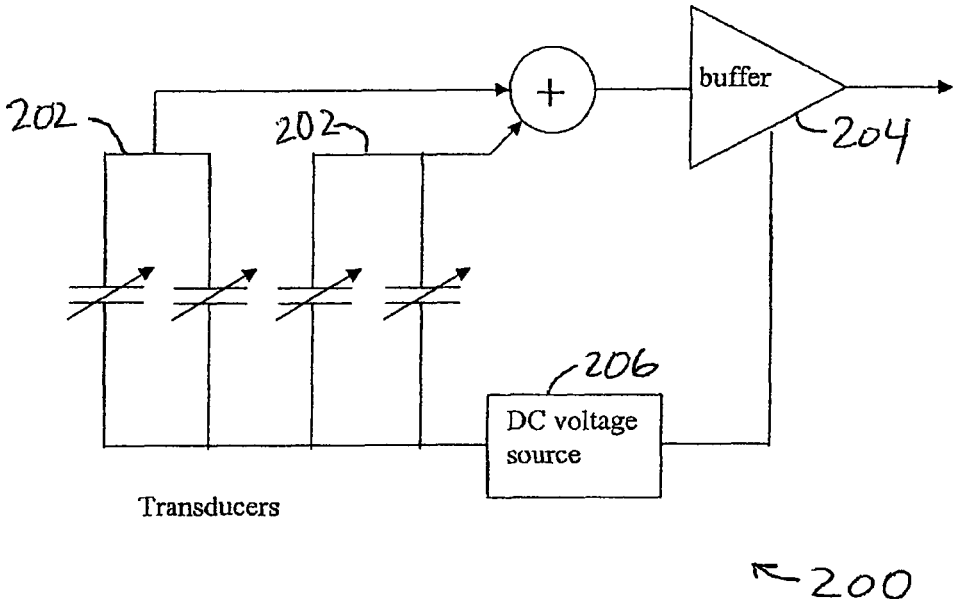
FIG. 9 is a schematic of a circuit showing connectivity of individual transducers to a buffer circuit in another embodiment of the present invention.

Another way of connecting the multiple transducer elements is by a summing method shown in a schematic 200 in FIG. 9. This can be utilized in the multiple transducer or monolithic transducer configuration. By summing pairs of transducer elements 202, higher microphone sensitivity can be achieved in addition to lower noise performance. The transducer elements can be connected to a buffer circuit 204. A DC voltage source 206 may be required for non-electret condenser transducer elements, but may not be required for electret style transducers.

An additional benefit in SNR is achieved by increased source capacitance. By connecting the individual transducers in parallel as shown in FIG. 8, the source capacitance of the multiple transducer system adds by the number of individual elements used. Because of the resulting increase in source capacitance, the buffer circuit noise decreases since the input thermal noise is delivered to a larger input capacitance, causing a decrease in the low-pass noise corner frequency, resulting in a decrease in the total integrated output noise.

While it is commonly known that summing correlated signal sources is a means of increasing SNR by increasing total signal by n*V while increasing total uncorrelated noise by SQRT(n), yielding a total SNR benefit of n/sqrt(n), this invention uses parallel connected sources to improve overall SNR.

By connecting sources in parallel as shown in FIG. 8, the correlated signal does not benefit from summing signals, but a benefit in SNR is still achieved. In addition to the benefit in signal to noise ratio, this solution yields a lower power system than can be achieved through summation alone. By utilizing only one buffer, electrical current is minimized when compared to a multi-buffer summation circuit.

Parallel connected sources can also be used to improve summed source designs. FIG. 9 shows a concept whereby parallel-connected sources 202 are arranged and summed to provide the SNR benefits of parallel-connected sources in addition to the benefits of increased sensitivity by post summing the parallel connected sources.

Preferred embodiments of this invention are described herein, including the best mode known to the inventors for carrying out the invention. It should be understood that the illustrated embodiments are exemplary only, and should not be taken as limiting the scope of the invention.

We claim:

1. A microphone package comprising:

a housing;

a microelectromechanical system (MEMS) acoustic transducer positioned in the interior of the housing, said transducer comprising a plurality of individual MEMS acoustic motor assemblies, each of said individual MEMS acoustic motor assemblies being variable capacitors well matched with one another with regard to sensitivity;

an integrated buffer circuit positioned in the interior of the housing; and an acoustic port in the housing, positioned to be aligned with the MEMS acoustic transducer;

where said individual MEMS acoustic motor assemblies are connected in parallel with one another and connected to the integrated buffer circuit.

2. A microphone package comprising:

a housing;

a microelectromechanical system (MEMS) acoustic transducer positioned in the interior of the housing, said transducer comprising at least four individual MEMS acoustic motor assemblies, each of said individual MEMS acoustic motor assemblies being variable capacitors well matched with one another with regard to sensitivity;

an integrated buffer circuit positioned in the interior of the housing; and an acoustic port in the housing, positioned to be aligned with the MEMS acoustic transducer;

where pairs of said individual MEMS acoustic motor assemblies are connected in parallel and said pairs are summed and connected to the buffer integrated circuit.

* * * * *

UNITED STATES PATENT AND TRADEMARK OFFICE

CERTIFICATE OF CORRECTION

PATENT NO. : 8,594,347 B2
APPLICATION NO. : 13/456348
DATED : November 26, 2013
INVENTOR(S) : William A. Ryan, Michael Abry and Peter V. Loeppert It is certified that error appears in the above-identified patent and that said Letters Patent is hereby corrected as shown below:

In the Claims:

Column 6, Lines 23 and 39: "an integrated buffer circuit" should read --a buffer integrated circuit--.

Column 6, Line 29: "the integrated buffer circuit" should read --the buffer integrated circuit--.

Signed and Sealed this
Twenty-fifth Day of March, 2014

Michelle K. Lee

Michelle K. Lee
*Deputy Director of the United States Patent and Trademark Office*